US005711178A

United States Patent [19]

Hogendoorn et al.

[11] Patent Number: 5,711,178

[45] Date of Patent: Jan. 27, 1998

[54] DIE FOR USE IN DIE-NECKING OF A METAL CAN BODY AND METHOD USING SUCH A DIE

[75] Inventors: Auke Hogendoorn, Heerhugowaard; Gerard M. Louwerse, Velserbroek; Hans N. Schaaper, Heemskerk, all of Netherlands

[73] Assignee: Hoogovens Staal BV, Ijmuiden, Netherlands

[21] Appl. No.: 668,475

[22] Filed: Jun. 25, 1996

[30] Foreign Application Priority Data

Jun. 26, 1995 [NL] Netherlands ..... 1000657

[51] Int. Cl.[6] ..... B21D 22/00; B21D 22/21

[52] U.S. Cl. ..... 72/352; 72/348

[58] Field of Search ..... 72/348, 349, 352, 72/354.6, 356, 379.4; 413/69

[56] References Cited

U.S. PATENT DOCUMENTS

| | | | |
|---|---|---|---|
| 3,771,476 | 11/1973 | Heinle | 72/350 |
| 3,964,413 | 6/1976 | Saunders . | |
| 3,995,572 | 12/1976 | Saunders . | |
| 4,403,493 | 9/1983 | Atkinson | 72/352 |
| 5,355,710 | 10/1994 | Diekhoff | 72/379.4 |

FOREIGN PATENT DOCUMENTS

| | | | |
|---|---|---|---|
| 0020926 | 1/1981 | European Pat. Off. . | |
| 4-9232 | 1/1992 | Japan | 72/379.4 |
| 8403873 | 10/1984 | WIPO . | |

OTHER PUBLICATIONS

European Search Report, Feb. 29, 1996.

*Primary Examiner*—Lowell A. Larson
*Assistant Examiner*—Rodney Butler
*Attorney, Agent, or Firm*—Watson Cole Stevens Davis, P.L.L.C.

[57] ABSTRACT

A die for use in a stage of a multi-stage die-necking process of a metal body such as a beverage can, has a surface around a center-line. The die surface, seen in longitudinal section through the center-line, has a profile which includes in direct succession a feed-in zone, an intermediate zone and a neck zone. The intermediate zone has, as well as a contact part, a relatively steep part in which tangents to the die surface include an angle $\alpha$ to the center-line greater than $\alpha_n$, where $\alpha_n$ is the neck angle between the necked part following die-necking and the center-line of the body. The presence of this non-contact steep part reduces the axial force needed in the die-necking.

19 Claims, 7 Drawing Sheets

DIE FOR USE IN DIE-NECKING OF A METAL CAN BODY AND METHOD USING SUCH A DIE

FIELD OF THE INVENTION

This invention relates to a die for use in a stage, other than the first stage, of a multi-stage process of die-necking of a metal can body, such as a beverage can body. The invention further relates to a method of die-necking of a metal can body in a plurality of die-necking stages using such a die.

DESCRIPTION OF THE PRIOR ART

A drinks or beverage can body commonly is formed as a one-piece drawn seamless tubular body having one end open for filling, prior to the attachment of the lid. To permit the lid to be attached, it is known to reduce the diameter of the can body adjacent the open end, i.e., to neck the can body. The can body is usually cylindrical, but the invention is not limited to this shape.

In this context necking is understood to be the process called die-necking, wherein the body being made is moved into a die with the end to be necked leading, which die is of such a shape that the neck size on the neck end is reduced. During die-necking the body is supported internally by applying into it an internal overpressure, and the neck is supported internally by a support element. The necking process is carried out in more than one stage, whereby a neck is formed on the body in a number of stages. By supporting the material at the neck the force to be exerted axially on the body for necking becomes increasingly greater, and in the last stages approaches the critical limit at which the body can still produce the axial force. In order to reduce the neck size as much as possible without damaging or collapsing the body, the shape of the body, particularly of its base, is optimized in order to enable this high force to be withstood successfully.

An example of such a known die is disclosed in U.S. Pat. No. 5,355,710. The die has an internal die surface around a centre-line. This internal surface has, as seen in a longitudinal section through the centre-line, a die profile which comprises in direct succession a feed-in zone, an intermediate zone and a neck zone. The radial spacing from the centre-line of the feed-in zone corresponds to the relative dimension of the body in the non-necked area bordering the necked part of the body, and the radial spacing of the neck zone corresponds to the desired neck size of the neck of the body. The intermediate zone has a shoulder shape with tangents to the die-shell surface at an angle to the centre-line corresponding to the neck angle between the necked part following die-necking and the centre-line of the body. It appears that, at least at the end of the stroke, i.e., the end of the movement of the can body into the die, the can body contacts the whole length of the intermediate zone, between the feed-in zone and the neck zone.

Similar dies are shown in WO-84/03873 and EP-A-20926. Dies which do not have a feed-in zone contacting and supporting the can body are also shown in EP-A-20926 and in U.S. Pat. No. 3,995,572.

SUMMARY OF THE INVENTION

The object of the invention is to provide a die, and a method for die-necking of a can body, which reduces the axial force which occurs in necking. In this aim, the invention deviates from the prior practice, in which it has been sought to strengthen and/or support the can body so that it can resist the axial force.

The invention lies in providing a second portion of the intermediate zone of the die, between the contact portion and the feed-in portion which also contacts the can body, the second portion having tangents at a steeper angle ($\alpha$) to the centre-line than the contact portion. In the method, this second portion remains out of contact with the can body, even at the end of the stroke. By this means it appears that the axial force can be substantially reduced, even by as much as several tens of percents. Alternatively, the same size reduction of the necked portion can be carried out in fewer necking stages, or a greater size reduction can be achieved in the same number of stages. This permits increased capacity and/or reduces costs.

According to the invention in a first aspect, there is provided a die for use in a stage, other than the first stage, of a multi-stage process of die necking of a metal can body. The die has a centre-line and an internal die surface extending around the centre-line for contacting a part of the can body which is being necked by relative movement of the can body and the die surface in a direction parallel to the centre-line. The die surface has, as seen in a longitudinal section including the centre-line, a profile comprising in direct succession a feed-in zone, an intermediate zone and a neck zone.

The feed-in zone has a spacing from the centre-line corresponding to the dimension of the can body at a non-necked part thereof adjacent the part being necked. The neck zone has a spacing from the centre-line corresponding to a desired neck size of a necked part of the can body after its die-necking in the die. The intermediate zone has, as seen in the longitudinal section including the centre-line, a contact surface part which has tangents at non-zero angles to the centre-line and which in use contacts the can body to shape the can body, and at a location between the contact surface part and the feed-in zone, a relatively steep surface part which has tangents at an angle $\alpha$ to the centre-line greater than an angle $\alpha_n$ which is the maximum angle between the necked part of the can body and its centre-line after the die-necking of the can body in the die.

The invention further provides a die, having a feed-in zone and a neck zone as described above, and an intermediate zone between them. The intermediate zone has, as seen in longitudinal section including the die centre-line, a contact surface part which has tangents at non-zero angles to the centre-line and which in use contacts the can body to shape the can body, and at a location between the contact surface part and the feed-in zone, a second surface part which has tangents at angles $\alpha$ to the centre-line which are not less than 40° and are greater than the maximum angle between the tangents of the contact surface part and the centre-line.

In another aspect, the invention provides a method of die-necking a metal can body to provide a neck thereon comprising performing a plurality of die-necking stages in which a part of the can body is progressively reduced in circumference. The method includes, in at least one of the die-necking stages, moving the can body relative to a die having an internal die surface extending around a centre-line and having, as seen in a longitudinal section including the centre-line, a profile comprising in direct succession a feed-in zone, an intermediate zone and a neck zone. The feed-in zone has a spacing from the centre-line corresponding to the dimension of the can body at a non-necked part thereof adjacent the part being necked, and the neck zone has a spacing from the centre-line corresponding to a desired neck size of a necked part of the can body after its die-necking in the die. The intermediate zone is a shoulder-shaped zone having a contact surface part which contacts the can body to effect re-shaping thereof and, at a location between the contact surface part and the feed-in zone, a relatively steep surface part which, as seen in the longitudinal section including the centre-line, has tangents at an angle $\alpha$ to the centre-line greater than an angle $\alpha_n$ which is the maximum angle between the necked part of the can body and its centre-line after the die-necking of the can body in the die.

The invention also consists in the use of a die of the invention as described above, in a stage of a multi-stage die-necking process.

By the method according to the invention, when the can body is made of packaging steel, its circumference at its necked part can be reduced more than 39 mm in not more than twelve of the die-necking stages.

Relative to a conventional can shaping process, the concept of the invention typically means an angle $\alpha \geqq 40°$. Although the effect of reducing the axial force required may already occur at an angle $\geqq 40°$, it is preferable and it is quite possible that the angle may be made even greater, for example $\geqq 50°$, $\geqq 60°$, $\geqq 70°$, 80°, or even $\geqq 90°$.

It can occur that the neck part formed in a preceding stage does not feed well into the following die. This problem is rectified in the invention in that the relatively steep part of the die is situated between the feed-in zone and the contact part near to the contact part. The contact part is a part of the die profile at which during the movement the body first comes into contact with the die surface. Due to a spring-back effect, this contact part will typically be on a somewhat greater radius than the neck zone in the last preceding stage. It is preferable for tangents to the die surface in the contact part to include a maximum angle $\beta$ to the centre-line between 30° and 40°.

By making any contact impossible at the relatively steep zone, it is found that friction is reduced, while surprisingly by modifying the die profile for the die part in question, no particular disadvantages are found to arise in respect of process operation or product quality in general and the neck shape in particular.

BRIEF INTRODUCTION OF THE DRAWINGS

The invention will now be illustrated by non-limitative embodiments which are described below and are shown in the accompanying drawings, in which.

DESCRIPTION OF THE PREFERRED EMBODIMENTS

FIGS. 2 to 6 have the relevant dimensions of the die in mm, which can be read from the figures by the expert.

Figure 1:
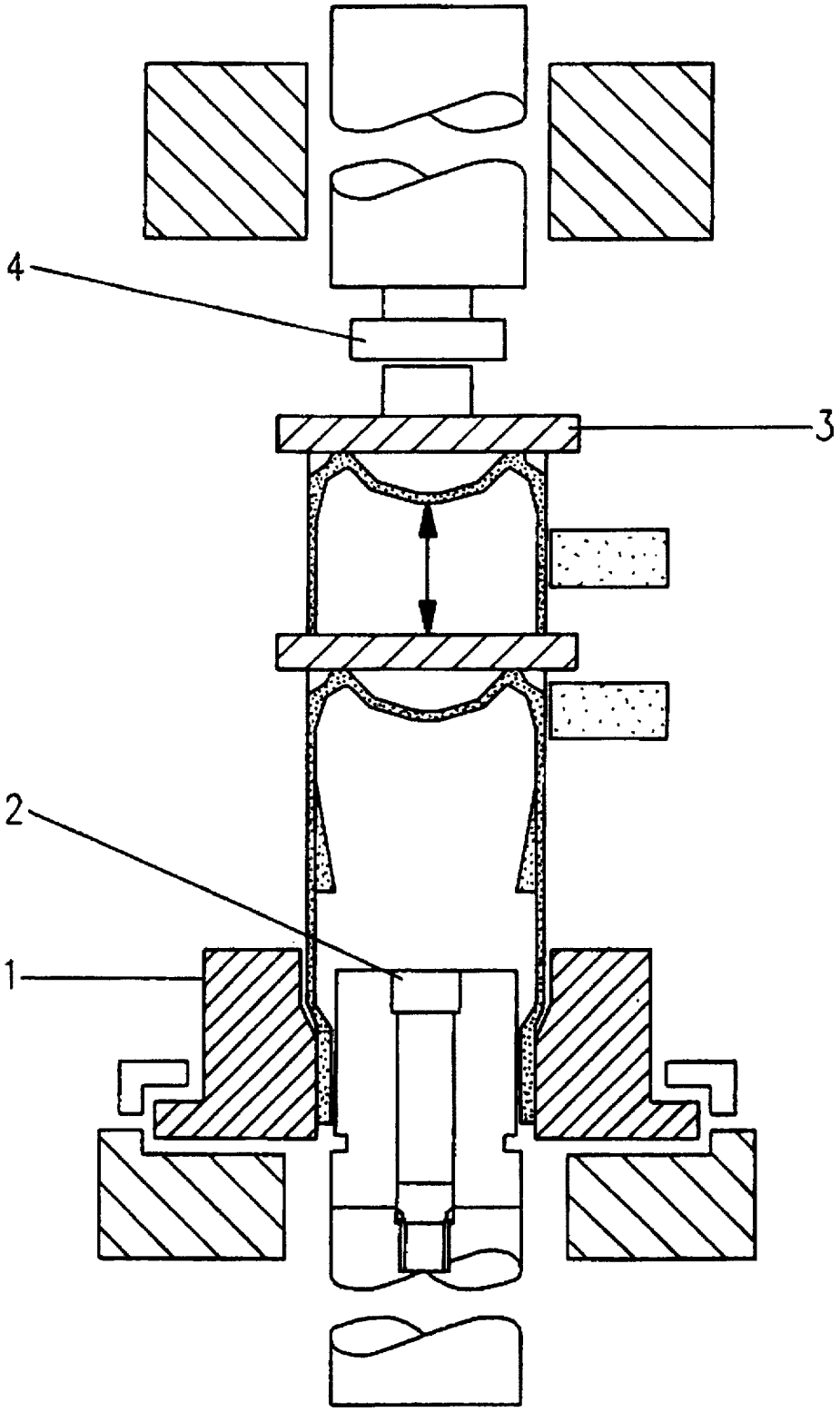
FIG. 1 shows the die-necking process schematically.

FIG. 1 shows a circle-cylindrical body of a beverage can which is positioned with its base against a punch 3. By moving punch 3 in the direction of die 1, a neck is formed at the end of the body which comes into contact with the die 1. The neck is supported on the inside by support element 2, also called a knock-out. A fluid can be supplied through a duct (not drawn) extending through the support element 2 for enabling the interior of the body to be pressurized in order to withstand the forces exerted on the body during necking. This process is conventional and need not be described here in detail.

FIG. 1 also shows a force sensor 4 which is used for sensing the axial force exerted by punch 3 on the base of the body.

Figure 2:
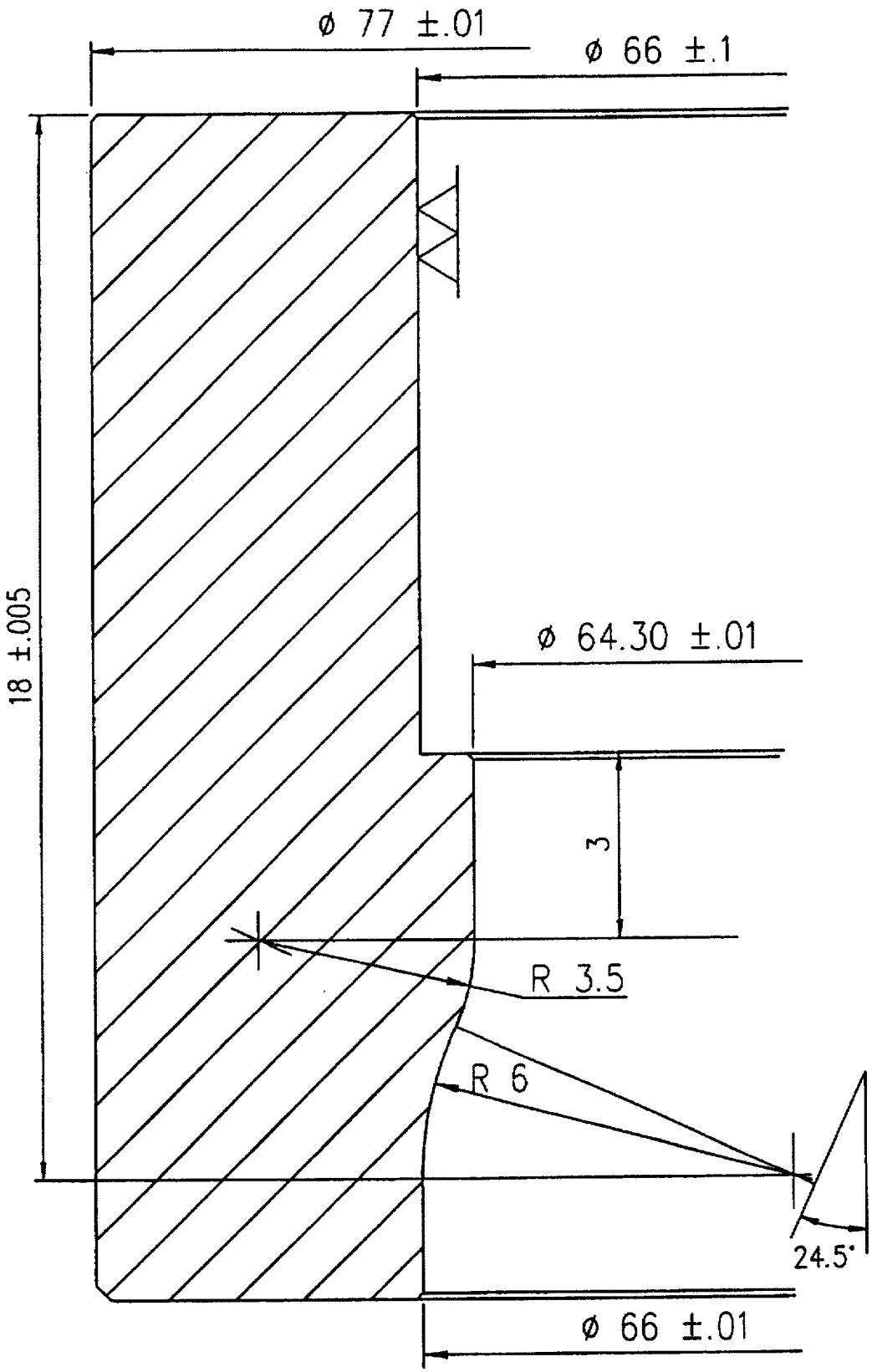
FIG. 2 shows a cross-section of a die in accordance with the state of the art.

FIG. 2 shows the die profile of a die for a first necking stage in accordance with the state of the art. In accordance with the state of the art, the profile shape shown is also given to the dies for the subsequent necking stages, but with a reduced radius at the neck zone for each necking stage. Moreover, in necking in accordance with the invention, at least the first necking stage, and possibly also a small number of subsequent necking stages, are carried out with a die in accordance with the state of the art.

As FIG. 2 shows, the die profile has a feed-in zone (at diameter 66 mm) which contacts and supports the can body at its non-necked part, and a neck zone (at diameter 64.30 mm) which contacts the necked-down part of the can body. Both of these zones in the dies here illustrated are parallel to the die centre-line, but either or both of them may alternatively be slightly tapered (the feed-in zone tapering inwardly in the feed-in direction of the can body and the neck zone tapering outwardly in this direction). Between the feed-in zone and the neck zone is an intermediate zone of curved shoulder profile at which the can body is given its correspondingly curved shoulder. At the end of the stroke, the entirety of the intermediate zone contacts the can body.

After the first necking stage is carried out, it is now advantageous to carry out other necking stages using the dies in accordance with the invention.

Figure 3:
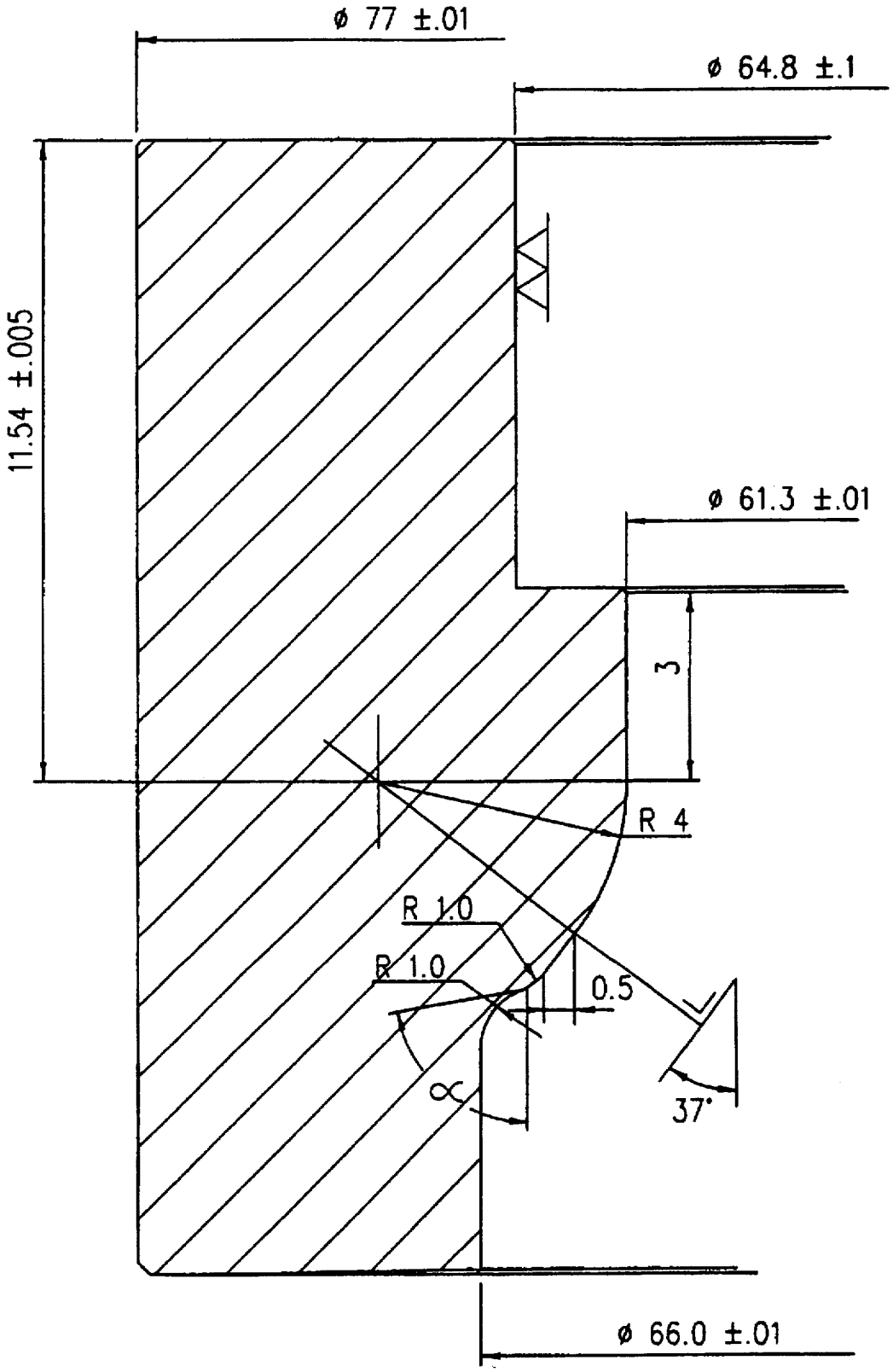
FIG. 3 shows a cross-section of a die in accordance with the invention intended for a fourth necking stage of a body of packaging steel of 66 mm diameter.

FIG. 3 shows the die profile of such a die in accordance with the invention, intended for the fourth necking stage of such a die-necking process, of a can body of diameter 66 mm. Along the profile from bottom to top there is a feed-in zone at a diameter 66 mm which along a rounding of radius 1 mm transfers into a steep part with an angle $\alpha$ of about 80° to the die centre-line. This transfers by another rounding of radius 1 mm into the contact zone having an angle $\beta$ of about 37°. This transfers via a rounding of radius 4 mm into the neck zone at a diameter 61.3 mm. Unless otherwise indicated, all dimensions in the text and figures are given in mm. Thus, on the side of the contact zone remote from the neck zone there is an indentation or recess which can clearly be seen forming the relatively steep part of the profile. At this indentation or recess, there is no contact with the can body, even at the end of the movement of the can body into the die, in the necking stroke.

Figure 4:
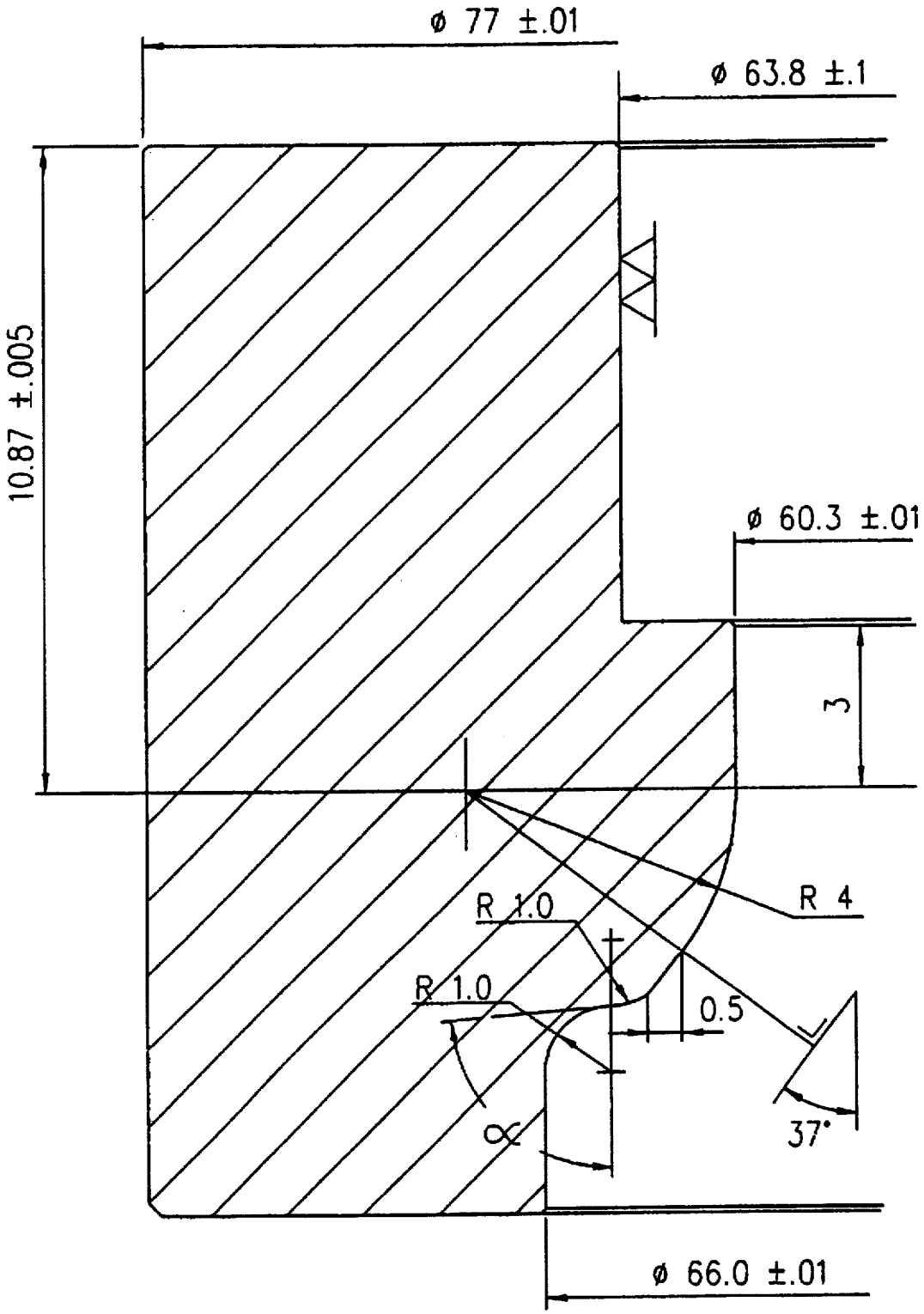
FIG. 4 shows a die cross-section of a die in accordance with the invention for a fifth necking stage following the fourth necking stage carried out in the die of FIG. 3.
Figure 5:
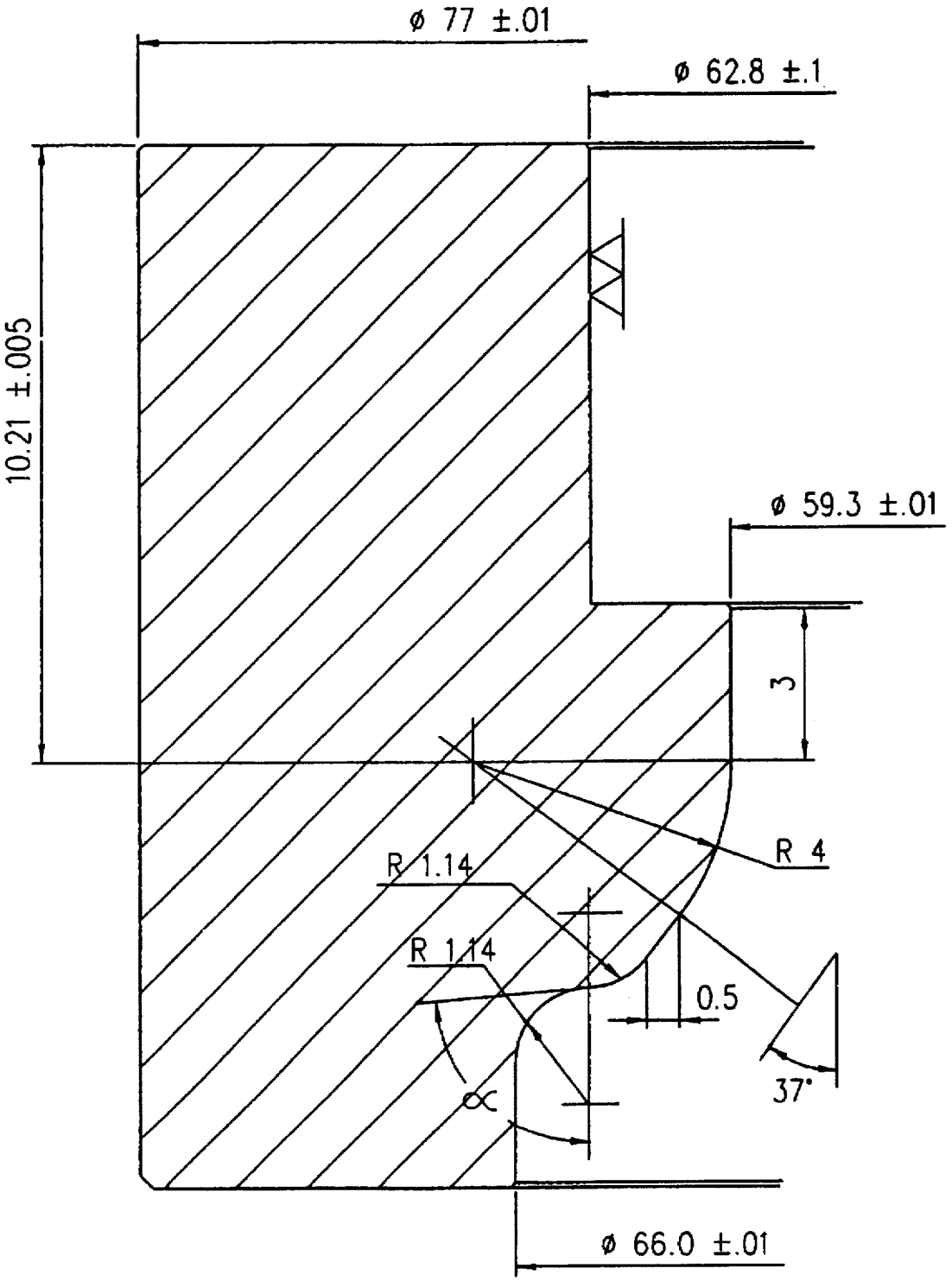
FIG. 5 shows a die in accordance with the invention for a subsequent sixth necking stage after the die of FIG. 4.
Figure 6:
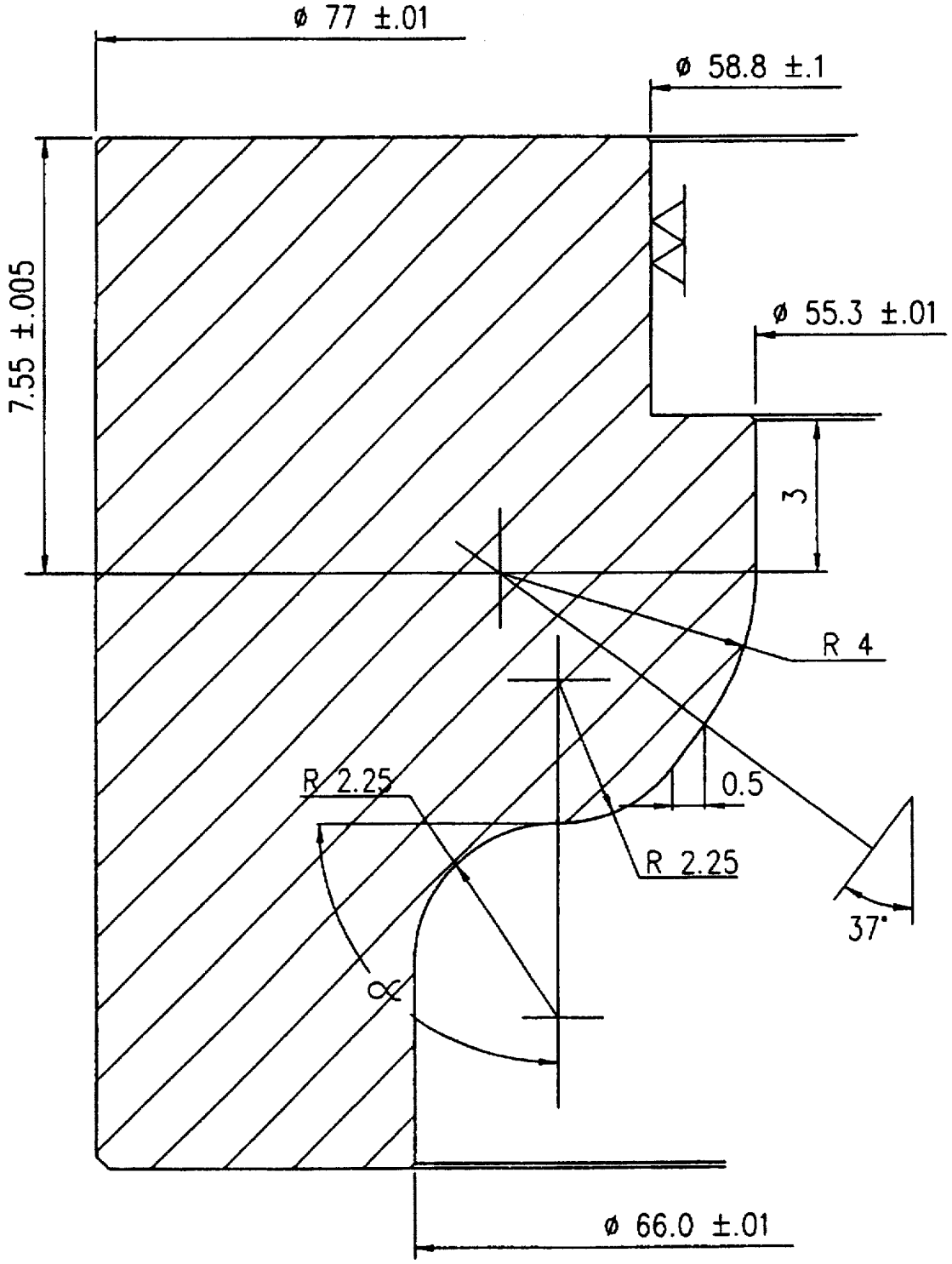
FIG. 6 shows a die in accordance with the invention for a subsequent tenth necking stage in the same multi-stage process.

FIGS. 4, 5 and 6 show respectively profiles for a fifth, sixth and tenth stage of this die-necking process in accordance with the invention.

In each of the dies of FIGS. 4 to 6, the maximum angle $\beta$ at the contact surface part is 37° to the die centre-line. This is the region of initial contact of the can body with the die in the necking stroke. Between this part and the feed-in zone there is, as in FIG. 3, a recessed surface part at which there is no contact with the can body. This recessed part has tangents at angles $\alpha$ substantially greater than $\beta$; in FIG. 4 the maximum angle $\alpha$ is 80°, in FIG. 5 the maximum angle $\alpha$ is 85° and in FIG. 6 the maximum angle $\alpha$ is 90°.

Figure 7:
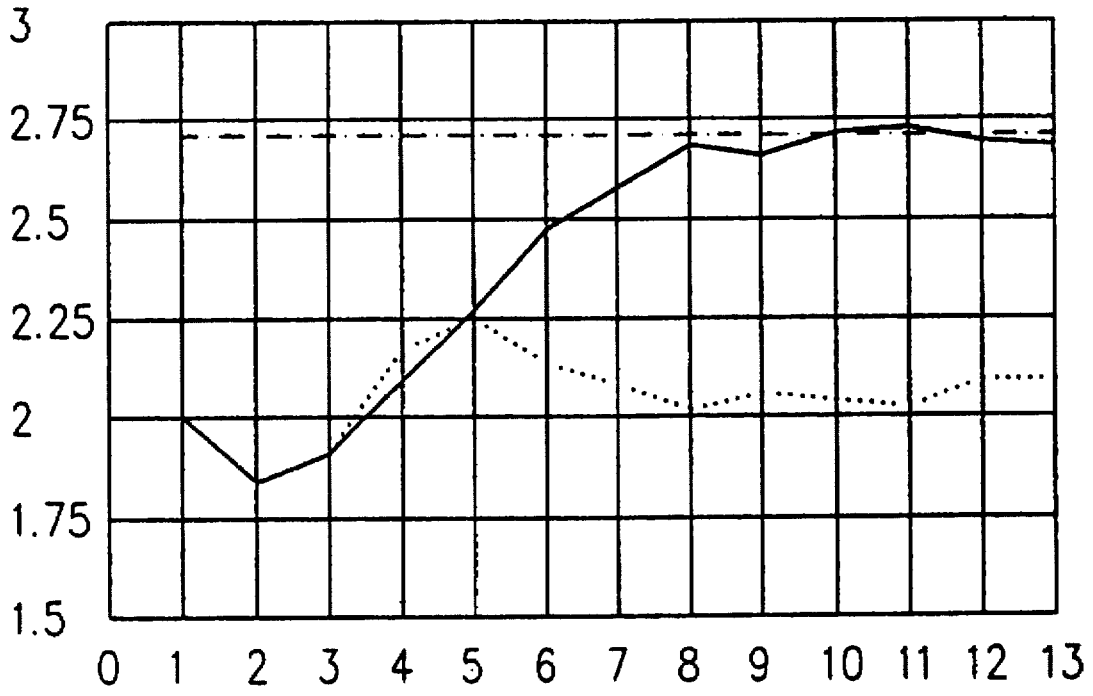
FIG. 7 shows in a graph the axial forces in the necking stages using dies of the conventional shape and dies in the shape in accordance with the invention.

In FIG. 7 the vertical axis expresses the highest axial force in kN exerted by punch 3 on the body and the horizontal axis expresses the necking stage number in the multi-stage necking processes. The force sensor 4 shown in FIG. 1 is used to determine the highest force occurring in each of the 13 necking stages. The first three necking stages are carried out with identical dies in the two processes, the highest forces occurring as shown by the unbroken line. From necking stage four the dotted line shows the forces measured when using dies in accordance with the invention as illustrated in FIGS. 3 to 6 for stages four, five, six and ten, and the continuous line shows the forces measured when using dies in accordance with the state of the art, that is to say dies of a profile shape displaying similarity to those shown in FIG. 2. The dashed/dotted line in FIG. 7 indicates a critical limit at which there is a risk of a body of packaging steel collapsing, namely at 2.71 kN in the case illustrated. It can be clearly observed that a substantial reduction of the axial loading of the body can be achieved by the invention, by an amount of over 500N.

In an embodiment of the invention, a can body of diameter 66 mm has reduced in diameter at its neck portion, using dies such as shown in FIGS. 3 to 6, to 53.3 mm in twelve steps, a circumference reduction of 39.9 mm.

It will be clear that the shape of the body is not limited to a purely circle cylindrical shape, but could also be, for example, a rounded-off square or elliptical shape. Although the results in FIG. 7 relate to packaging steel, in the invention the body material is also not limited to steel.

The invention also makes it possible to arrive at can bodies which may be sealed with yet smaller lids.

Although embodiments have been described for explanation and illustration, the invention is not limited to them but includes modifications and improvements within the scope of the inventive concept herein disclosed.

What is claimed is:

1. Die for use in a stage, other than a first stage, of a multi-stage process of die-necking of a metal can body, which die has a centre-line and an internal die surface extending around said centre-line for contacting a part of said can body which is being necked by relative movement of said can body and said die surface in a direction parallel to said centre-line, said die surface having, as seen in a longitudinal section including said centre-line, a profile comprising in direct succession a feed-in zone, an intermediate zone, and a neck zone, said feed-in zone having a spacing from said centre-line corresponding to the dimension of said can body at a non-necked part thereof adjacent the part being necked, said neck zone having a spacing from the centre-line corresponding to a desired neck size of a necked part of said can body after its die-necking in the die, and said intermediate zone having, as seen in said longitudinal section including said centre-line, a contact surface part which has tangents at non-zero angles to said centre-line and which in use contacts said can body to shape the can body, and at a location between said contact surface part and said feed-in zone, a relatively steep surface part which has tangents that extend at an angle $\alpha$ to said centre-line greater than a maximum angle $\alpha_n$ between said tangents of said contact surface part and said center-line of tangents to said contact surface part relative to said centre-line.

2. Die according to claim 1 wherein $\alpha \geqq 40°$.

3. Die according to claim 1 wherein tangents at said contact surface part extend at a maximum angle of 30° to 40° to said centre-line of the die.

4. Die according to claim 2 wherein $\alpha \geqq 50°$.

5. Die according to claim 4 wherein $\alpha \geqq 60°$.

6. Die according to claim 5 wherein $\alpha \geqq 70°$.

7. Die according to claim 6 wherein $\alpha \geqq 80°$.

8. Die according to claim 7 wherein $\alpha \geqq 90°$.

9. Die for use in a stage, other than the first stage, of a multi-stage process of die necking of a metal can body, which die has a centre-line and an internal die surface extending around said centre-line for contacting a part of said can body which is being necked by relative movement of said can body and said die surface in a direction parallel to said centre-line, said die surface having, as seen in a longitudinal section including said centre-line, a profile comprising in direct succession a feed-in zone, an intermediate zone and a neck zone, said feed-in zone having a spacing from said centre-line corresponding to the dimension of said can body at a non-necked part thereof adjacent the part being necked, said neck zone having a spacing from said centre-line corresponding to a desired neck size of a necked part of said can body after its die-necking in the die, and said intermediate zone having, as seen in said longitudinal section including said centre-line, a contact surface part which has tangents at non-zero angles to said centre-line and which in use contacts said can body to shape the can body, and at a location between said contact surface part and said feed-in zone, a second surface part which has tangents that extend at angles $\alpha$ to said centre-line which are not less than 40° and are greater than the maximum angle between said tangents of said contact surface part and said centre-line.

10. Die according to claim 9 wherein $\alpha \geqq 50°$.

11. Die according to claim 10 wherein $\alpha \geqq 60°$.

12. Die according to claim 11 wherein $\alpha \geqq 70°$.

13. Die according to claim 12 wherein $\alpha \geqq 80°$.

14. Die according to claim 13 wherein $\alpha \geqq 90°$.

15. Method of die-necking a metal can body to provide a neck thereon comprising the steps of (a) positioning an open end of a metallic can body within an initial die having an internal die surface extending around a centre-line thereof and moving said can body relative to said first die to begin formation of a necked part of said can body, and subsequently (b) positioning the necked part of said can body within a subsequent die having an internal die surface extending around a centre-line thereof and moving said can body relative to said subsequent die to continue formation of a necked part of said can body, said subsequent die as seen in a longitudinal section including said centre-line, comprising an internal die surface profile defining in direct succession a feed-in zone, an intermediate zone and a neck zone, said feed-in zone having a spacing from said centre-line corresponding to the dimension of said can body at a non-necked part thereof adjacent the part being necked, said neck zone having a spacing from said centre-line corresponding to a desired neck size of the necked part of said can body after step (b), and said intermediate zone being a shoulder-shaped zone having a contact surface part which contacts said can body to effect reshaping thereof and, at a location between said contact surface part and said feed-in zone, a relatively steep surface part which, as seen in said longitudinal section including said centre-line, has tangents that extend at an angle $\alpha$ to said centre-line greater than an angle $\alpha_n$ which is the maximum angle between said necked part of said can body and its centre-line after the die-necking of said can body in the subsequent die in step (b).

16. Method according to claim 15 wherein said can body is made of packaging steel and its circumference at its necked part is reduced more than 39 mm in not more than twelve of said die-necking stages.

17. Method of die-necking of a metal can body to provide a neck thereon comprising, the steps of (a) positioning an open end of a metallic can body within an initial die having an internal die surface extending around a centre-line thereof and moving said can body relative to said first die to begin formation of a necked part of said can body, and subsequently (b) positioning the necked part of said can body within a subsequent die having an internal die surface extending around a centre-line thereof and moving said can body relative to said subsequent die to continue formation of a necked part of said can body, said subsequent die as seen in a longitudinal section including said centre-line, comprising an internal die surface profile defining in direct succession a feed-in zone having a spacing from said centre-line corresponding to the dimension of said can body at a non-necked part thereof adjacent the part being necked, said neck zone having a spacing from said centre-line corresponding to a desired neck size of the necked part of said can body after step (b), and said intermediate zone being a shoulder-shaped zone having a contact surface part which in step (b) contacts said can body to effect re-shaping thereof, said intermediate zone further having, between said contact surface part and said feed-in zone, a non-contact surface part which remains out of contact with said can body during the movement of said can body relative to said subsequent die in step (b).

18. Method according to claim 17 wherein said can body is made of packaging steel, and its circumference is reduced at its necked part by more than 39 mm in not more than twelve of said die-necking stages.

19. Die according to claim 18 wherein tangents at said contact surface part extend at a maximum angle of 30° to 40° to said centre-line of said die.

* * * * *